United States Patent [19]

Clare et al.

[11] 4,416,385

[45] Nov. 22, 1983

[54] FREIGHT CONTAINERS

[75] Inventors: Kenneth D. Clare, Cheadle; Michael F. J. Ambrose, Macclesfield, both of England

[73] Assignee: Fairey Engineering Limited, Hounslow, England

[21] Appl. No.: 333,626

[22] Filed: Dec. 22, 1981

[30] Foreign Application Priority Data

Dec. 23, 1980 [GB] United Kingdom ..... 8041268

[51] Int. Cl.[3] ..... B65D 19/04; B65D 88/00; B65D 81/02

[52] U.S. Cl. ..... 220/1.5; 108/55.1; 206/386; 217/43 A

[58] Field of Search ..... 220/1.5, 4 F; 108/55.1; 217/43 A; 410/120; 206/319, 386

[56] References Cited

U.S. PATENT DOCUMENTS

| | | | |
|---|---|---|---|
| 2,428,500 | 10/1947 | Nutt | 206/319 |
| 2,556,418 | 6/1951 | Del Mar | 220/1.5 X |
| 3,088,619 | 5/1963 | Boucher | 220/1.5 |
| 3,138,398 | 6/1964 | Silverman | 108/55.1 X |
| 3,502,237 | 3/1970 | Verhein et al. | 220/4 F |
| 3,568,912 | 3/1971 | de Simas | 108/55.1 X |
| 3,602,376 | 8/1971 | De Piano | 220/1.5 X |
| 3,749,273 | 7/1973 | Wreghitt et al. | 220/1.5 |
| 3,797,691 | 3/1974 | Williams, Jr. | 220/1.5 |
| 3,972,439 | 8/1976 | Di Martino | 220/1.5 X |
| 3,980,185 | 9/1976 | Cain | 220/1.5 X |
| 3,995,396 | 12/1976 | Spector | 220/4 F X |
| 4,015,715 | 4/1977 | Kelf | 206/386 X |
| 4,249,684 | 2/1981 | Miller et al. | 220/1.5 X |
| 4,256,236 | 3/1981 | Haase | 220/4 F X |

FOREIGN PATENT DOCUMENTS

| | | | |
|---|---|---|---|
| 2397340 | 2/1979 | France | 220/403 |

*Primary Examiner*—Allan N. Shoap
*Assistant Examiner*—Robert Petrik

[57] ABSTRACT

A stackable freight container comprising a rigid bottomless container body 10 and a separate freight-carrier pallet 11 which can be bolted into the open underside of the body 10 by means of shoot-bolts 37 to close the container and form its load-carrying floor. When the closed container is placed on a flat supporting surface 40 the lower edges of the body 10 rest on the surface 40 with the loaded pallet 11 supported clear of the surface 40 by the shoot-bolts 37, the weight of the loaded pallet 11 then preventing the withdrawal of the shoot-bolts. To open the container it must be lowered on to packing 39 to take the weight of the loaded pallet 11 off the shoot-bolts 37 so that they can be withdrawn.

The body 10 can be used inverted as a floating pontoon unit, whose deck is afforded by the pallet 11.

8 Claims, 13 Drawing Figures

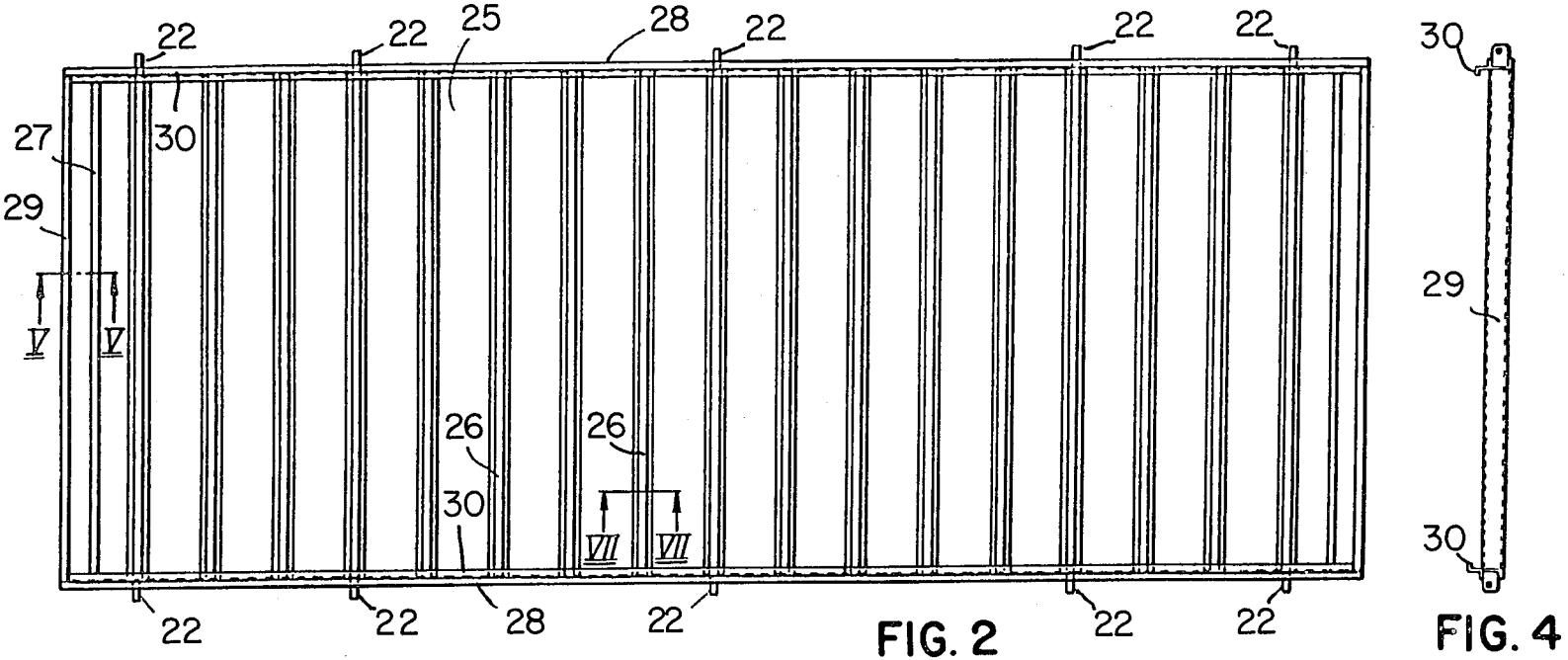
FIG. 4
FIG. 2
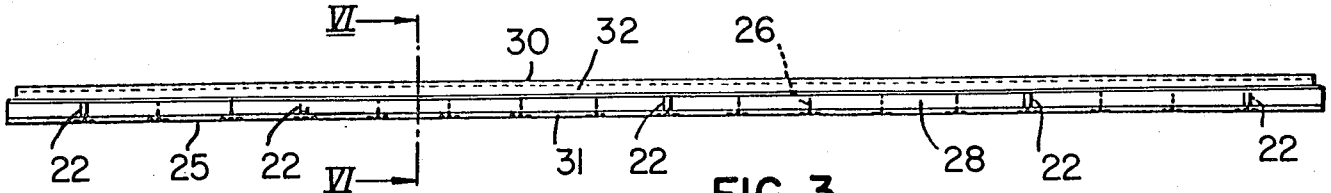
FIG. 3

FREIGHT CONTAINERS

This invention relates to stackable freight containers.

An object of the invention is to provide an improved construction of stackable freight container which can be constructed in accordance with the ISO specifications and standards laid down by the International Organisation for Standardisation for containers for road, rail and sea transport, but will provide operational advantages and improved security during transit as compared with conventional ISO freight containers.

According to the present invention, a stackable rectangular freight container comprises a rigid bottomless rectangular container body having a doorless top wall and four doorless side walls, the top wall and side walls being permanently joined together at their adjacent edges along the respective edges of the container body, and only access to the interior of the container body being through the open lower side, in combination with a rigid load-supporting pallet of rectangular profile over which the container body can be lowered to enclose a load supported on the pallet, the pallet then forming the floor of and totally closing the container, and means being provided for releasably securing the peripheral edge of the pallet to the lower edges of at least two opposite side walls of the container body to secure the container in its closed condition.

This construction has advantage of simplicity and flexibility in use over a conventional ISO container which has to be loaded through its end doors. The detachable pallet will be loaded and unloaded when separated from the container body. freight can be loaded onto it whilst supported on simple packing, making use of the free access from all sides and above, and can be secured by conventional means such as hold-down lashings or freight storage nets, as desired. Last-minute changes of load can be accommodated with ease, and special environmental protection can be applied to one or more parts or to the whole of the freight load. When the pallet is fully loaded the container body can be lowered over it and secured, producing a loaded container which can be handled in the same manner as a conventional freight container and whose doorless body construction provides improved inherent security in transit.

In this specification and claims expressions such as "top wall", "floor", "upper", "lower" and the like refer to the condition when the container body is disposed with its "top wall" upper most and its open side facing downwardly, with or without the pallet in position closing the open side to form the floor of the freight container.

The principle of the invention, that the container floor is separable from the remainder of the container and is usable as a load-supporting pallet enables improved utilisation rates for the container to be achieved. In suitable controlled warehousing or other loading/unloading environments, the container body can be immediately released for other use and the pallet left behind for unloading or loading as required. Hence different quantities or distributions of container bodies and pallets can be used, to meet shipment requirements.

The construction of the container may be such that in the closed condition the lower edges of the container body lie outside and around the peripheral edge of the pallet. This arrangement will usually be preferred, both to facilitate sealing and from the point of view of appearance. Preferably a resilient seal is provided between the container body and the pallet around the entire periphery of the pallet.

In one preferred form of the invention, the container is constructed and arranged so that when in use the closed container is placed on a flat supporting surface the container body rests on the supporting surface with the pallet suspended clear of the supporting surface by the container body through the releasable securing means.

For example, the container body may have support members at its four lower corners which project downwardly below the level of the lower edges of the container body, for use in stacking the container on another container, and so that when in use the closed container is placed on a flat supporting surface, only the four support members rest on the supporting surface and support the closed container thereon with the pallet suspended clear of the supporting surface.

Such arrangements provide improved inherent security for the closed container in transit, because the weight of the loaded pallet resting on the securing devices will make it difficult to release them. To open the container it must first be lifted and lowered onto packing which will support the weight of the loaded pallet and relieve the securing devices, which can then be released to allow the container body to be lifted off the pallet. The loaded pallet during transit is enclosed by and suspended from the container body walls, the freight load being supported by the securing devices. The absence of doors in the container body, and the need to separately support the pallet so as to relieve the securing devices of the weight of the load, help to prevent unauthorised access to the load, such as is relatively easy in the case of conventional freight containers via their endloading doors.

In one such construction the pallet has outwardly-projecting lugs on at least two opposite edges which enter into cooperating recesses in the lower edges of the corresponding side walls of the container body when the latter is lowered over the pallet, and the securing devices comprise shoot bolts which are slidably mounted in the lower edges of the side walls of the container body and can be advanced through cooperating apertures in the pallet lugs to bolt the pallet in its position closing the bottom of the container body. The arrangement may be such that when the container body is fully lowered over the pallet with the pallet supported on packing above a supporting surface, the side walls of the container body will rest on the pallet lugs to allow the shoot bolts to be advanced through the apertures in the lugs to bolt the pallet in position.

It is also possible for the container body to be so constructed that parts or the whole of each of two opposite lower edges of the body will project below the bottom of the pallet to support the whole container on a flat supporting surface with the pallet suspended by the securing means. In such cases it may be necessary to use packing which does not project beyond the periphery of the pallet, when opening and closing the container.

The container of the invention can be utilised in a flotation role if, in accordance with a further optional feature of the invention, the container body when inverted is watertight and buoyant. The inverted container can then be used as a floating vessel or pontoon unit, with the pallet secured in the closed position to form a deck for the floating body. Means may be provided for joining together several of the inverted container bodies end-to-end and/or side-by-side. In this role the container may be used as a pontoon in the construction of floating bridges or rafts. It may also be used as a barge.

The invention may be carried into practice in various ways, but one specific embodiment thereof will now be described by way of example only and with reference to accompanying drawings, in which FIG. 1 is a perspective view of a freight container embodying the invention, shown with the container body raised above the pallet;

FIGS. 2, 3 and 4 are respectively a plan, and side and end elevations of the pallet of FIG. 1;

Figure 1:
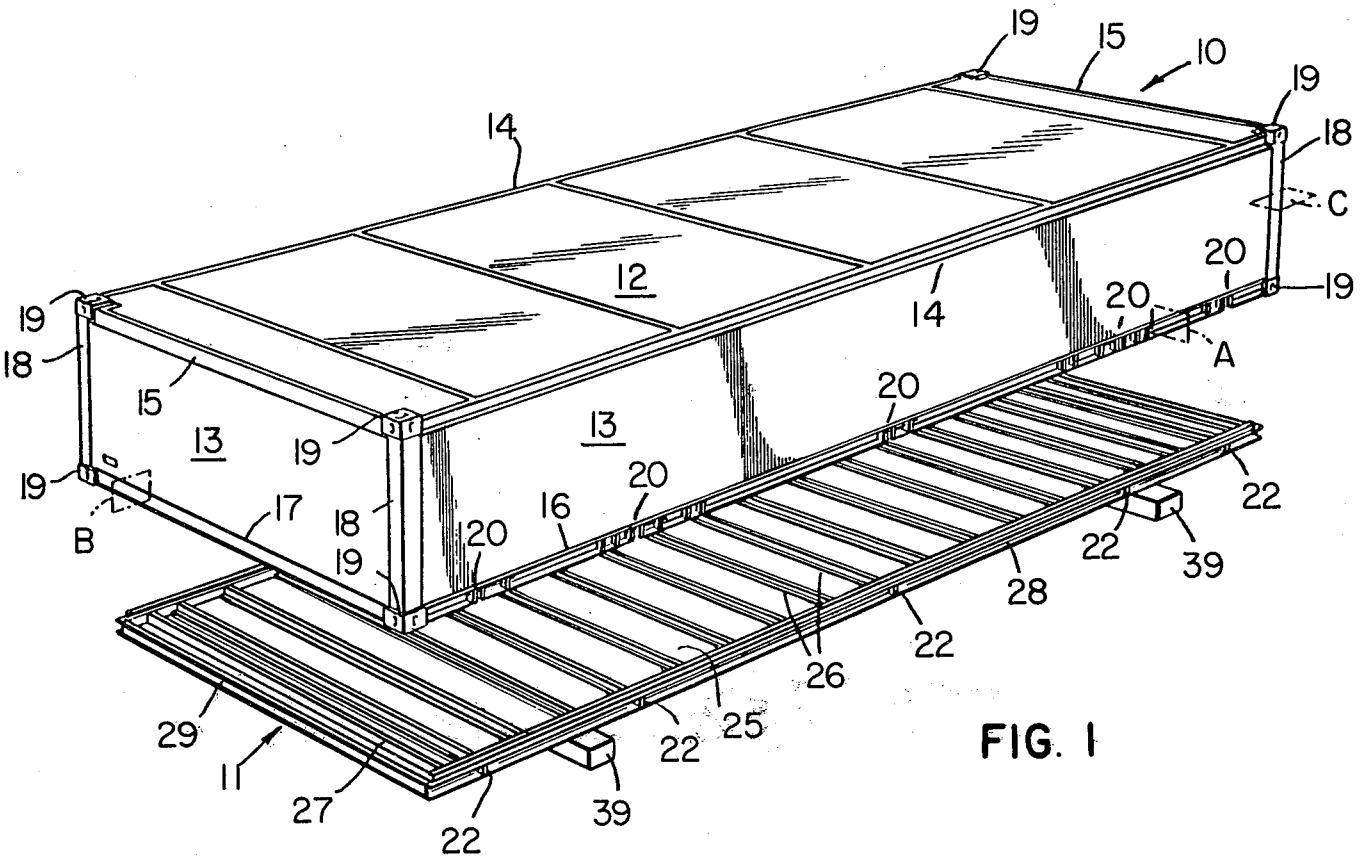
Figure 11:
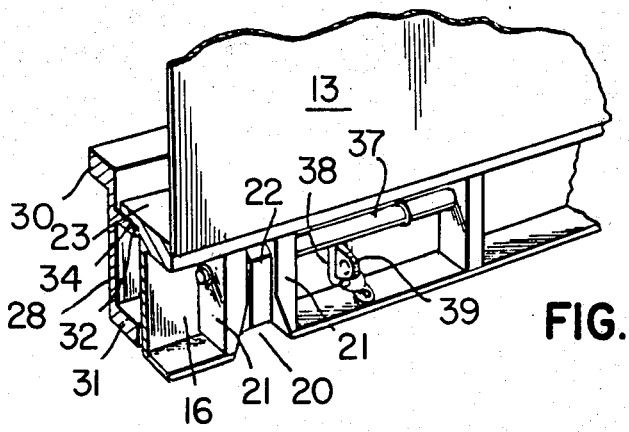
Figure 12:
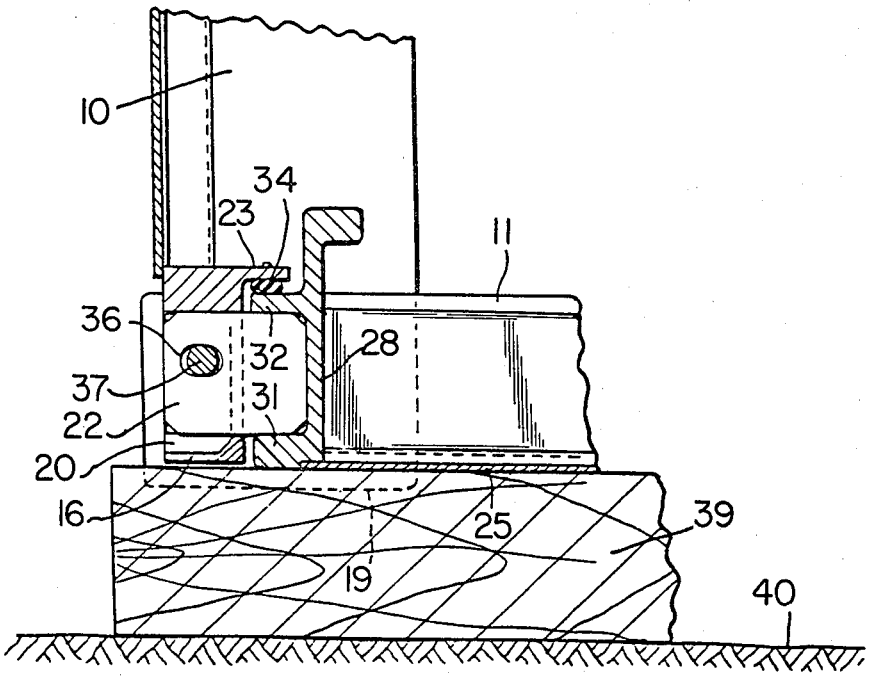
Figure 13:
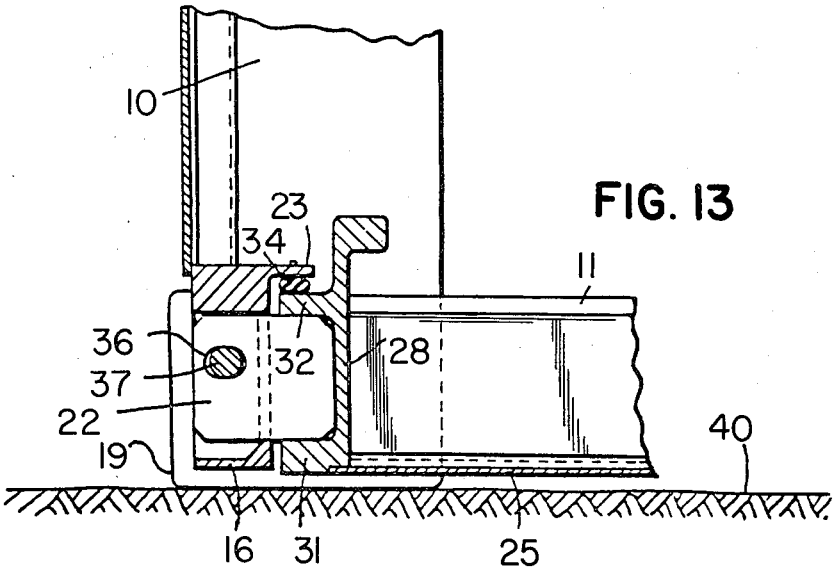

FIG. 11 is a fragmentary perspective view, on a larger scale than in FIG. 1, showing one of the shoot bolt arrangements for securing the pallet to the container body; and FIGS. 12 and 13 are large-scale fragmentary sectional views, taken in a vertical plane, transverse to the longitudinal edge of the pallet, and illustrating the adjoining edge parts of the pallet and container body, respectively in the condition for bolting/releasing the container body to/from the pallet, and in the transit condition.

The stackable freight container shown in the drawings comprises a bottomless rectangular container body 10 and a separate freight-carrier pallet 11 which can be bolted into the open under side of the container body to close the container and form its load-carrying floor. In the closed condition the approximate overall dimensions of the container are 6058 mm in length, 2438 mm in width and 1219 mm in height (roughly 20 feet×8 feet×4 feet). It is designed to ISO requirements for general freight containers in all aspects. Its load capacity is 5 tons, and it is to be capable of supporting, stacked on it, a second similar fully-loaded container plus five fully-loaded standard ISO containers type IC under ISO stacking conditions. Other sizes and capacities of the illustrated design of container are possible.

The container body 10 is constructed in orthodox fashion from aluminium alloy members and utilises riveted and welded joints. The roof and side walls 12 and 13 are of sheet metal panels with stiffeners, and they are bounded by a rectangular framework of edge members 14, 15, 16, 17 and 18.

Figure 8:
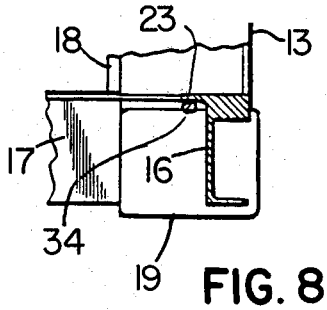
FIGS. 8 and 9 are fragmentary sectional views taken in vertical planes of portions of the container body of FIG. 1, respectively in the areas indicated at A and B in FIG. 1, and on a larger scale.
Figure 9:
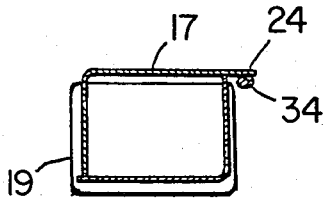
Figure 10:
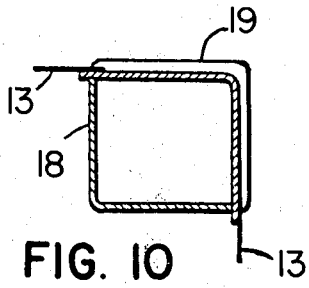
FIG. 10 is a fragmentary sectional view taken in a horizontal plane in the area indicated at C in FIG. 1, also on a larger scale.

The lower edge members 16 and 17 of the four side walls are respectively of flanged channel section (FIG. 8) and of hollow rectangular-section fabricated construction (FIG. 9). Four upright corner posts 18 with ISO corner fittings 19 at their opposite ends are provided being hollow rectangular-section fabricated post members. The corner fittings 19 are designed to conform to standard practice for load-carrying, stacking, securing, lifting and other general handling purposes. The lower longitudinal edge rail 16 on each side of the container body is provided at five spaced positions with recesses 20 bounded by pairs or reinforcing plates 21(FIG.11) to receive protruding lugs 22 on the pallet edge, and with associated sliding bolt and locking arrangements, as will be described. There are no doors in the roof or side walls of the container body, and the adjacent edges of the roof and side walls are permanently joined together by the framework 14 to 18. The lower edge rails 16 and 17 have in-turned flanges 23 and 26, shown in FIGS. 8 and 9.

Figure 5:
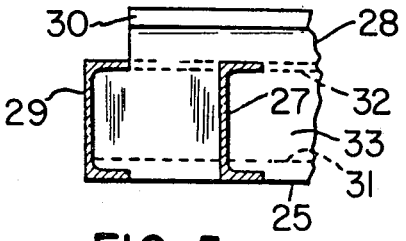
FIGS. 5, 6 and 7 are fragmentary sectional views of portions of the pallet, taken on the lines V—V, VI—VI and VII—VII in FIGS. 2 and 3, and on a larger scale.
Figure 6:
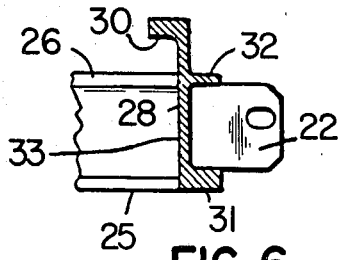
Figure 7:
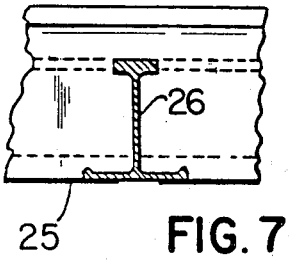

The pallet 11 follows a somewhat similar construction to that of the body 10. It has a flat rectangular bottom 25 formed of sheet metal panels stiffened by I-section and channel-section transverse stiffeners 26 and 27, and is bounded by longitudinal and lateral edge rails 28 and 29. As shown in FIGS. 5 and 6 each of the longitudinal lower rails 28 has an inturned upper flange 30, and out-turned lower and intermediate flanges 31 and 32 protruding from the vertical web 33. The pallet dimensions enable the peripheral edge of the pallet to be enclosed within the lower edge rails 16 and 17 of the container body so that the pallet closes the open bottom of the container body and forms the floor of the closed container. In this closed position the flanges 23, 24 of the container body edge rails 16 and 17 overlie the flanges 32 and the top flanges of the pallet rails 29, and a resilient seal 34 carried by the flanges 23, 24 of the body 10 is compressed between them and the pallet flanges to seal the joint around the entire circumference of the pallet.

Each of the longitudinal edge rails 28 of the pallet 11 carries the five protrucing lugs 22 in positions to mate with and enter the recesses 20 in the lower side rail 16 of the container body, and each lug 22 is formed with a locking hole 36 to receive a shoot bolt 37 slidably mounted in the side rail 16, as shown best in FIGS. 11, 12 and 13. Each shoot bolt 37 is provided with a hasp 38, and a cooperating staple 39 is mounted on the web of the rail 16 to enable the shoot bolt to be padlocked and/or sealed in its bolted position securing the pallet to the container body. The transverse stiffeners 26 and/or 27 of the pallet are fitted with anchor points for use with straps, ropes, etc., to hold down freight loaded onto the pallet 11.

The method of loading/unloading the container and of securing it in the closed position for transit will now be described, with particular reference to FIGS. 12 and 13. For loading, the pallet 11 separate from the container body 10 is supported upon transverse packing 39, for example a pair of wooden packers spaced apart to underlie the pallet at two places as shown in FIG. 1. The thickness of the packing must be sufficient to raise the under surface of the pallet bottom 25 a minumum of 25 mm clear of the ground or supporting surface 40. After the required load of freight has been loaded onto the pallet 11 and secured, by net, straps or other conventional means, the container body 10 is lowered, by means of a crane or other standard container lifting equipment, down over the loaded pallet until it is supported on the pallet. This position is shown in FIG. 12, and it will be observed that the bottoms of the lower rails 16 of the container body 10 are spaced slightly above the packing 39 whilst the lower corner fittings 19 project downwardly below the level of the upper faces of the packing 39. The recesses 20 located around the pallet lugs 22, and the weight of the container body rests upon the upper edges of the pallet lugs 22. The flanges 23, 24 of the lower edge rails of the container body overlie the pallet flanges 32 and rails 29, and compress the seal 34 between themselves and the flanges 32 and rails 29 respectively. The shoot bolts 37 can slide freely into and through the holes 36 in the lugs 22 now aligned with cooperating holes in the reinforcing plates 21, and the bolts are now slid into their locking positions to bolt the container body to the pallet, and are padlocked and/or sealed in the appropriate manner. The loaded container is now locked and sealed in the closed position, and can be handled as a whole in a manner as normal for freight containers. Thus the loaded container will be lifted off the packing and lowered onto a supporting surface for transit. During transit the loaded container rests on the supporting surface, be it the ground or a vehicle or another container, in the manner shown in FIG. 13, i.e. with only its four lower corner fittings 19 resting on the supporting surface to support the container. In this condition the weight of the loaded pallet 11 is supported entirely by the shoot bolts 37 which extend through the lugs 22 and suspend the loaded pallet from the container body 10 clear of the supporting surface. Very little relative movement within structural clearances is needed to effect this load transference, and the closure seal 34 remains effective. It will be appreciated that in this transit condition the weight of the loaded pallet bearing on the ten shoot bolts 37 effectively prevents the bolts from being slid back to their released position even if their locks/seals have been broken, thus making it extremely difficult to obtain unauthorised access to the interior of the container since there are no doors in the container body itself.

The procedure for unloading is the reverse of that used for loading. The loaded and closed container is swung down onto packing to relieve the weight of the pallet and load from the shoot bolts, which can then be released and the container body lifted off the pallet to give access to the load.

The container body 10 is of a watertight construction and will float when inverted. The inverted containers can therefore be used in the empty state as pontoon units, e.g. for bridge support, or even as barges. The container bodies are inverted and if necessary joined together end-to-end, and bow adaptors are fitted. The pallets 11 are inverted and fitted into the upwardly-facing open sides of the inverted bodies 10, where they are locked by the shoot bolts and form a sealed decking for the unit or assembly, which can be launched and anchored. Several of the inverted containers or container assemblies can be attached side-by-side to form floating pontoon piers or rafts, on which a bridge system can be supported e.g. across a river.

In this floating role, the container or container assembly can also be used as a freightcarrying barge if provided with a suitable towing facility. The freight is loaded into the inverted container body or bodies and is covered by the inverted pallet(s) which is/are secured as in the freight container role. Alternatively the freight could be secured on top of the decking formed by the inverted pallet (s).

What we claim is:

1. A stackable rectangular freight container which comprises a rigid bottomless rectangular container body having a doorless top wall and four doorless side walls, the top wall and side walls being permanently joined together at their adjacent edges along the respective edges of the container body, and the only access to the interior of the container body being through the open lower side, in combination with a rigid load supporting pallet of rectangular profile over which the container body can be lowered to enclose a load supported on the pallet, the pallet then forming the floor of and totally closing the container, and means being provided for releasably securing the peripheral edge of the pallet to the lower edges of at least two opposite side walls of the container body to secure the container in its closed condition such that in the closed condition the lower edges of the container body lie outside and around the peripheral edge of the pallet, said container body including support means configured so that when said container is used the closed container is placed on a flat supporting surface and said support means of the container body rests on the supporting surface with the pallet suspended clear of the supporting surface by the container body through the releasable securing means.

2. A freight container as claimed in claim 1, in which said support means of the container body comprises support members at the four level corners of the container body which project downwardly below the level of the lower edges of the container body, for use in stacking the container on another container, and in which, when in use the closed container is placed on a flat supporting surface, only the four support members rest on the supporting surface and support the closed container thereon with the pallet suspended clear of the supporting surface.

3. A freight container as claimed in claim 2 in which the container body has further support members at its four upper corners which project upwardly above the level of the upper surface of the top wall, for use in stacking another container thereon.

4. A freight container as claimed in claim 1, in which the pallet has projecting lug means on at least two opposite edges which enter into cooperating recess means in the lower edges of the corresponding side walls of the container body when the latter is lowered over the pallet, and in which the securing means comprise shoot bolts which are slidably mounted in the lower edges of the side walls of the container body and can be advanced through cooperating apertures in the pallet lug means to bolt the pallet in its position closing the container body.

5. A freight container as claimed in claim 4, in which said lug means and said recess means are configured such that when the container body is fully lowered over the pallet with the pallet supported on packing above a supporting surface, the side walls of the container body will rest on the pallet lug means to allow the shoot bolts to be advanced through the apertures in the lug means to bolt the pallet in position.

6. A freight container as claimed in claim 1, provided with a resilient seal between the container body and the pallet around the entire periphery of the pallet.

7. A freight container as claimed in claim 1, in which the container body when inverted is watertight and buoyant, and can be used as a floating vessel or pontoon unit, with the pallet of the inverted container body secured in the closed position to form a deck for the floating body.

8. A freight container as claimed in claim 7, including means for joining together several of the inverted container bodies end-to-end and/or side-by-side.

* * * * *